US006250790B1

(12) United States Patent
Montet

(10) Patent No.: US 6,250,790 B1
(45) Date of Patent: Jun. 26, 2001

(54) MOTOR VEHICLE HEADLIGHT WITH A TRANSVERSE LAMP, HAVING AN IMPROVED LAMP MOUNT

(75) Inventor: Maurice Montet, Paris (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 09/386,815

(22) Filed: Aug. 31, 1999

(30) Foreign Application Priority Data

Sep. 4, 1998 (FR) ..... 98 11078

(51) Int. Cl.[7] ..... F21V 7/04
(52) U.S. Cl. ..... 362/549; 362/507; 362/548
(58) Field of Search ..... 362/459, 475, 362/487, 506, 507, 505, 519, 546, 548, 549, 547, 226

(56) References Cited

U.S. PATENT DOCUMENTS 5,727,863 * 3/1998 Pruett ..... 362/551

FOREIGN PATENT DOCUMENTS 2 701 539 8/1994 (FR) .

* cited by examiner

*Primary Examiner*—Thomas M. Sember
*Assistant Examiner*—Ismael Negron
(74) *Attorney, Agent, or Firm*—Morgan & Finnegan LLP

(57) ABSTRACT

A motor vehicle headlight, in particular a foglight, has a lamp which is mounted with a reflector, together with a cover lens. The lamp has mounting means, such as an end cap, for engagement in a plane at right angles to the optical axis of the reflector. The reflector is made of injection moulded plastics, and is stripped from the mould in a direction parallel to the optical axis. The reflector comprises a base portion and at least one adjacent further portion. The further portion has a lamp hole formed through it, and an external surface of a wall of the reflector surrounding the lamp hole makes a rake angle with the direction of stripping the reflector from the mould. Between this external surface and the mounting means of the lamp itself, adapter means have surfaces for engagement by the mounting means of the lamp in a plane parallel to the optical axis.

15 Claims, 5 Drawing Sheets

FIG_6
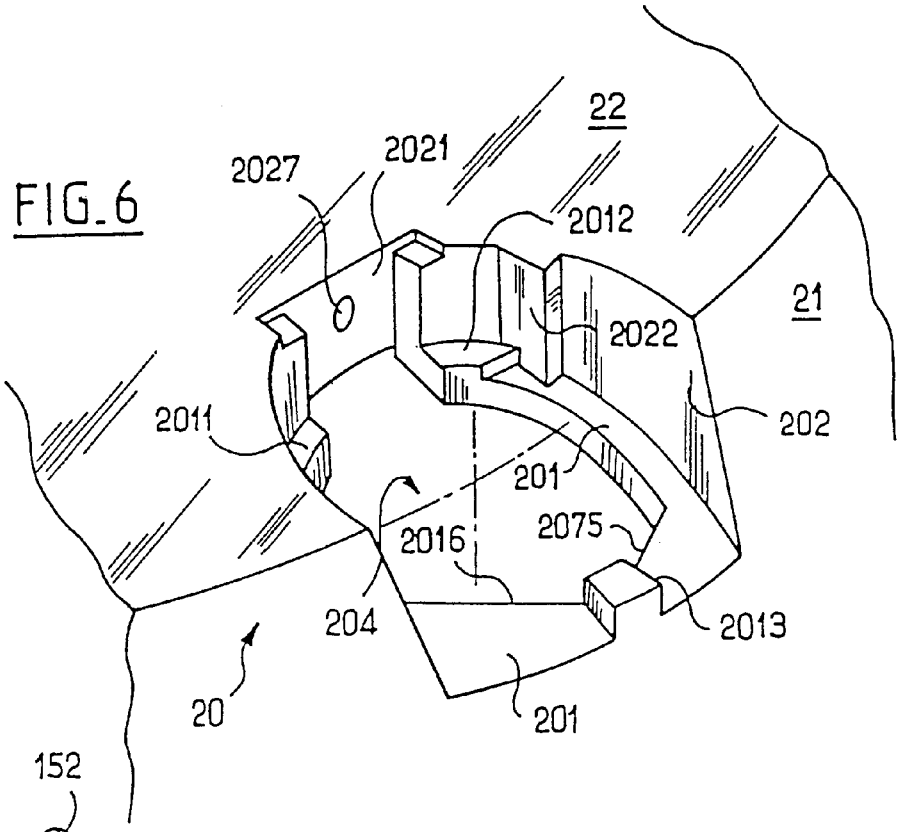
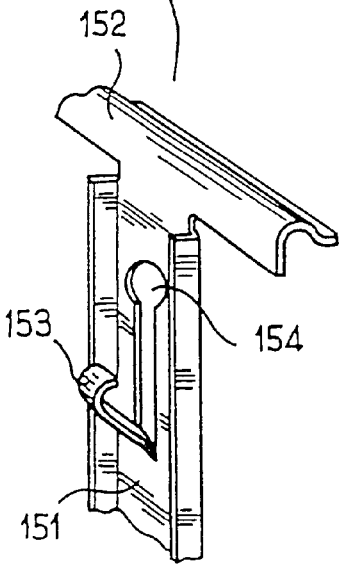
FIG_7
FIG_8
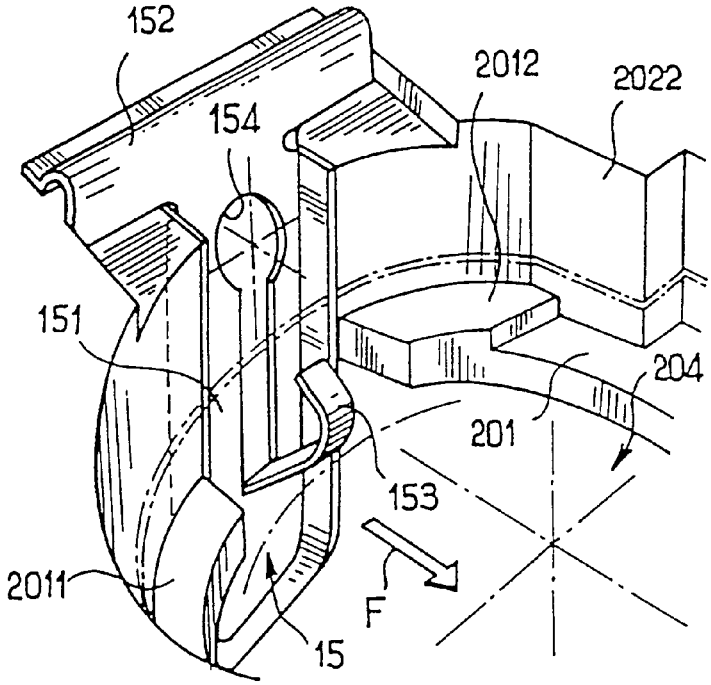

MOTOR VEHICLE HEADLIGHT WITH A TRANSVERSE LAMP, HAVING AN IMPROVED LAMP MOUNT

FIELD OF THE INVENTION

The present invention relates in general terms to motor vehicle headlights, and more particularly to a headlight having a lamp the axis which is oriented at right angles to the optical axis of the reflector of the headlight.

BACKGROUND OF THE INVENTION

It is known that such a lamp orientation has certain advantages in a headlight. In particular, the base zone of the reflector becomes able to be used for forming the beam, which is of particular importance in the case of reflectors which are capable of generating by themselves beams having the required photometry, such as cut-off beams, and in particular cut-off beams for foglights.

Another advantage of this type of known light lies in the fact that access to the lamp for replacing it, from above or through the side of the light or from below, can be made easier in certain types of configurations. Such a light is described for example in French published patent specification No. FR 2 701 539A.

However, that known headlight does have the disadvantage that it necessitates, for mounting the lamp, a special lamp holder or lamp mount, which is fitted on appropriate elements in the reflector, and which includes means adapted to receive the lamp. The presence of such a lamp mount increases the selling cost of the headlight and the time necessary for fitting it. In addition, replacement of the lamp is a trickier operation, because it is necessary to withdraw the lamp holder, to replace the lamp, and then to replace the lamp holder in position.

In addition, such a lamp mount or lamp holder can be seen through the cover glass of the reflector, and is detrimental to its appearance when the light is extinguished.

DISCUSSION OF THE INVENTION

An object of the present invention is to overcome the disadvantages of the state of the art, and to propose a headlight having a transverse lamp, in which the lamp can be mounted directly on appropriate elements of the reflector and can be easily replaced, without compromising or rendering particularly delicate the manufacture of this reflector by moulding.

In this connection, the use of moulding to make modern reflectors is an important factor in the quality of the product and the selling cost and efficiency of its manufacture. This must not be compromised just on grounds of saving on the cost of a component which constituted the lamp mount in the prior art.

According to the invention, a motor vehicle headlight, comprising a lamp mounted in a reflector, together with a cover lens, the lamp having mounting means for engagement in a plane at right angles to its axis and being mounted in the reflector with its axis at right angles to an optical axis of the reflector, the reflector being formed by injection moulding in a plastics material, having been stripped from the mould in a direction parallel to the said optical axis, the reflector having at least one portion adjacent to a base portion thereof, is characterised in that a lamp hole is formed directly in the said at least one reflector portion, in that an external surface of a wall of the reflector surrounding the lamp hole defines a rake angle with respect to the direction of stripping from the mould, and in that there is provided, between the said surface and the said mounting means of the lamp, adapter means which define, for engagement with the said mounting means of the lamp, seating surfaces lying in a plane parallel to the said optical axis.

Various preferred features of the invention, which are not to be taken as limiting, and which may be applied separately or, where appropriate, in combination, are as follows:

- the said lamp hole and the said surface surrounding the lamp hole are formed in a reinforcement provided in the said reflector portion;
- the said reinforcement is defined by a generally U-shaped wall;
- the said generally U-shaped wall has at least one locating element for the angular positioning of the lamp;
- the said generally U-shaped wall has at least one reinforcement adapted to receive a fastening lug of a lamp mask;
- the said fastening lug has a portion defining an elastic tongue which is adapted to bias the lamp for its location in a direction transverse to the axis of the said lamp;
- the said adapter means comprise a plurality of pads projecting from the said external surface and formed integrally by moulding during manufacture of the reflector;
- it further includes a member for retaining the lamp with its mounting means pressing on the said pads;
- the retaining member consists of a hairpin-type spring clip articulated on the said mask fastening lug;
- the said adapter means comprise a generally cylindrical adapter member surrounding the lamp hole and having a first edge which is in engagement against the said external surface, together with a second edge opposite the first edge, defining seating surfaces for the said mounting means of the lamp;
- the first edge and the second edge of the said adapter member consist essentially of circles contained in planes which are inclined with respect to each other by an angle equal to the rake angle;
- the first edge of the adapter member bears on pads formed integrally by moulding and projecting from the said external surface;
- the said adapter member has notches for mounting of the lamp therein by a bayonet device;
- the said seating surfaces defined by the second edge of the adapter member are formed on lugs lying in a plane at right angles to the axis of the said member;
- the said adapter member is made by rolling a thin piece of sheet metal.

Further features and advantages of the invention will appear more clearly on a reading of the following detailed description of some preferred embodiments of the invention, which are given by way of non-limiting example only and with reference to the accompanying drawings.

BRIEF DESCRIPTION OF THE DRAWINGS

FIG. 6 is a perspective view seen in another orientation, showing another embodiment of the lamp mount.

FIG. 7 shows, in perspective, a metal component which is adapted to be mounted adjacent to the lamp mount in the second embodiment shown in FIG. 6.

FIG. 8 is a partial view in perspective, of the lamp mount equipped with the component shown in FIG. 7.

DESCRIPTION OF PREFERRED EMBODIMENTS OF THE INVENTION

Figure 1:
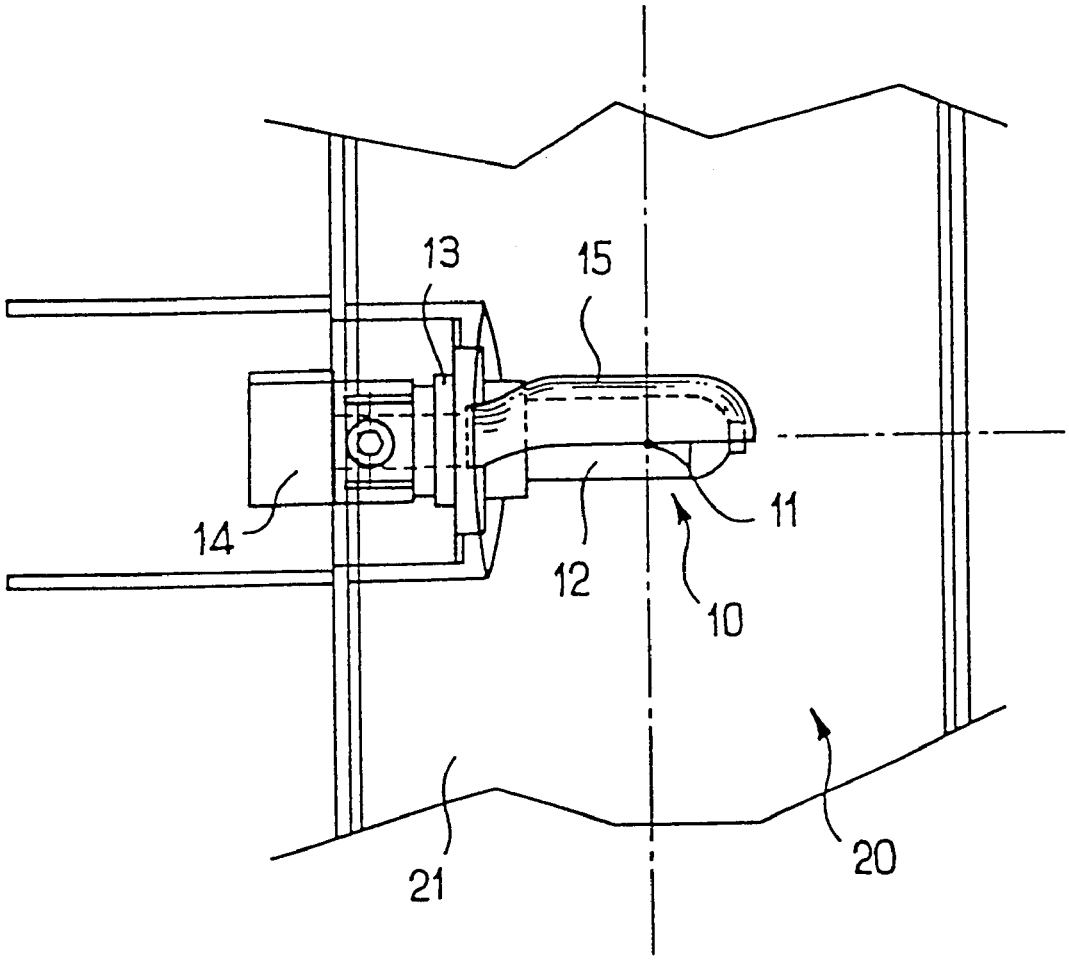
FIG. 1 is a front view showing part of a headlight in accordance with the invention.
Figure 2:
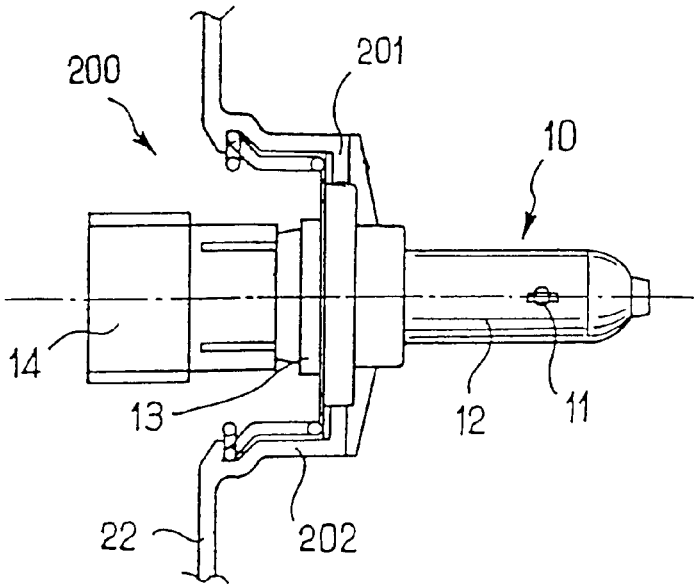
FIG. 2 is a rear view in partial cross section of a lamp mount of the reflector of the same headlight.
Figure 3:
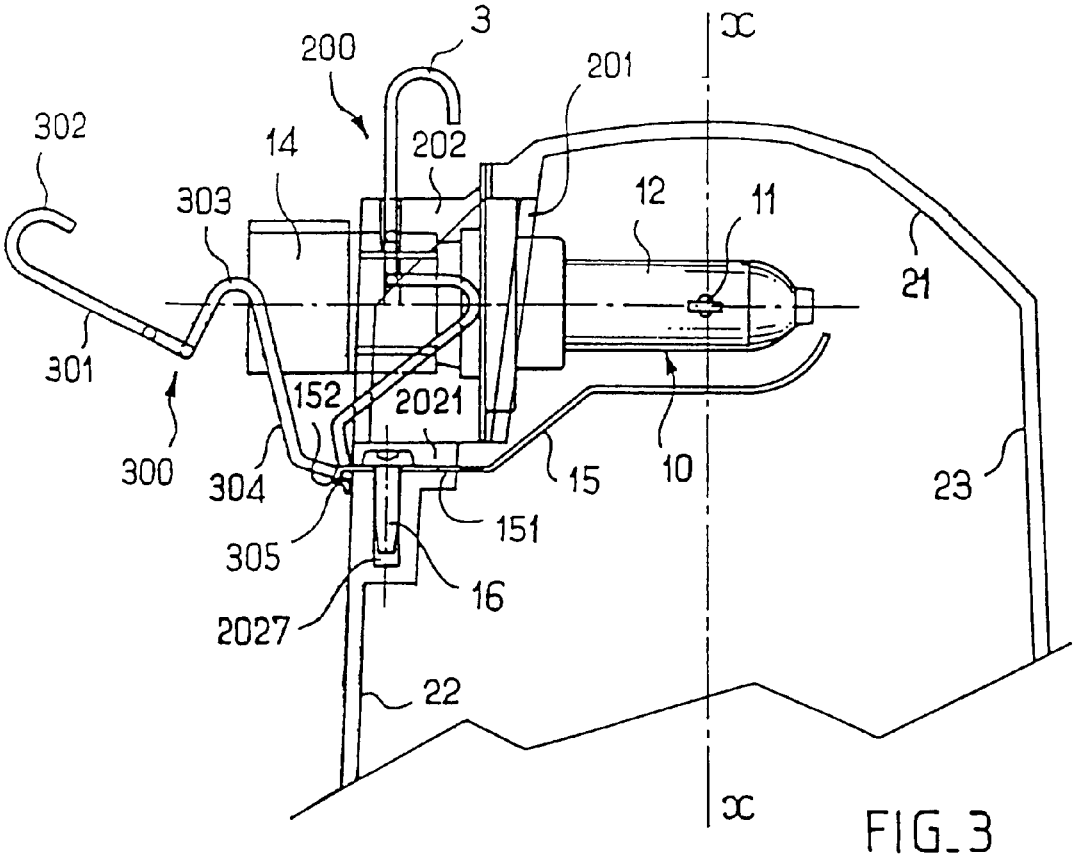
FIG. 3 is a top plan view in partial cross section of the base region of the reflector, including the lamp mount.

Reference is first made to FIGS. 1 to 3, which show a headlight that includes a lamp 10 and a reflector 20, together with (in a manner well known per se and not shown) a cover lens and, if appropriate, a casing.

The lamp 10 has a filament 11 extending along its axis within a bulb is 12, and a base 13. A supply connector 14 is also shown.

The reflector 20 has a base portion 21 which is adapted to cooperate with the lamp 10 so as to generate a beam having a desired photometry, for example a fog penetrating beam. The reflector also includes two further portions 22 and 23, which in this example are lateral or side portions, though they could be so positioned that they are an upper portion and a lower portion. In the region of the further portion 22 adjacent to the base 21 of the reflector, there is formed a lamp mount 200, in which the lamp 10 is fitted.

It will be noticed here that the manufacture of the reflector by moulding implies the availability of a mould cavity and a mould core, the surfaces of which define a rake angle with respect to the direction of stripping from the mould. In this example the rake angle gives the inclination of the reflector portions 22 and 23 with respect to the optical axis x—x of the reflector, which corresponds to the stripping direction.

Given that a conventional lamp occupies its reference position by engagement of its base collar against a plane at right angles to the axis of the lamp, it will now be understood that, if it is desired to give the lamp 10 an orientation at right angles to the optical axis X—X, the problem then inevitably arises as to the stripping of the above mentioned engagement surface from the mould, because this surface would then have to extend parallel to the optical axis, that is to say parallel to the stripping direction. It will therefore not be able to define the necessary rake angle.

In the headlights illustrated in the drawings, the lamp mount 200 is defined in the first place by particular arrangements determined by moulding during manufacture of the reflector. These arrangements essentially comprise a cavity, the base of which is defined by a base wall 201 which follows a rake angle of, for example, 7°, and further delimited by a lateral wall 202 which is generally U-shaped. A lamp hole 204 is formed in the base wall 201, for the lamp 10 to pass through it. The size of this hole is such that the base wall 201 defines a shoulder 203 substantially right around it. The base wall 201 also has, localised around the hole 204, three discrete seating pads 2011, 2012 and 2013, for three reference bosses which are arranged on the base collar of a normalised lamp such as a lamp of the H1, H4 or H7 type.

Figure 4:
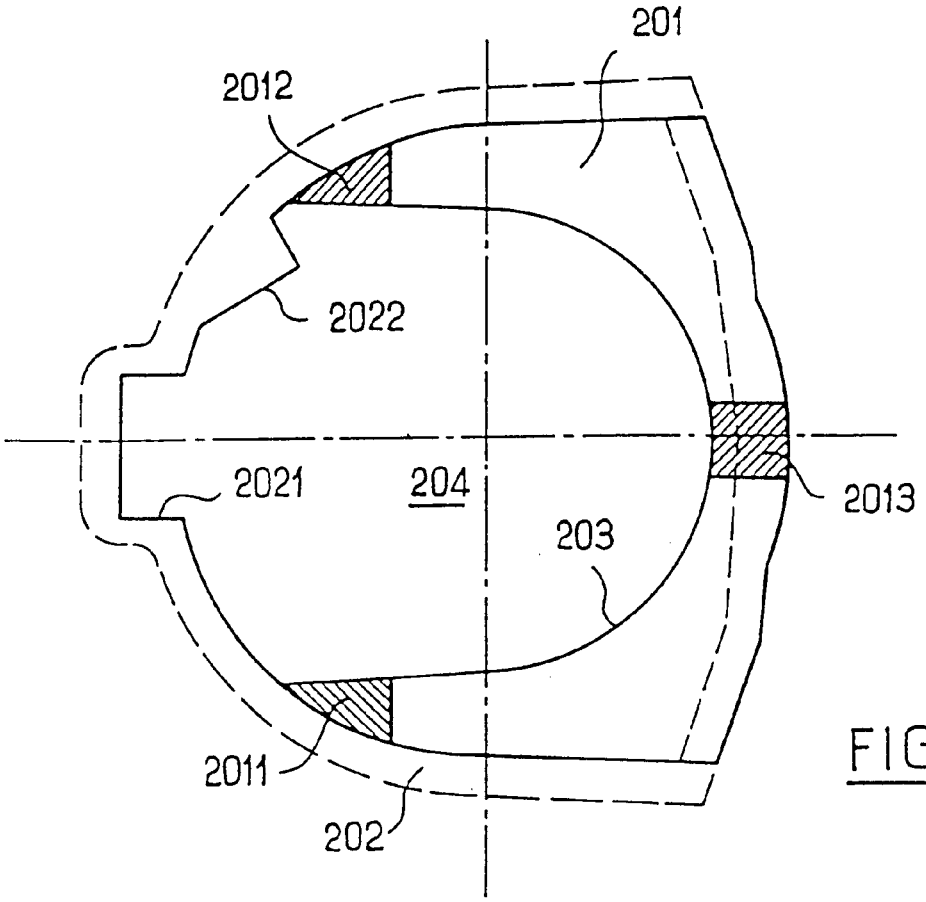
FIG. 4 is a top plan view showing part of the lamp mount.

These three seating pads lie in a common plane which is located as accurately as possible on the optical axis X—X of the reflector. Due to the fact that each of these pads has a limited surface area, it remains possible to strip the reflector from the mould in spite of the absence of any rake angle in the region of the surfaces of these pads. As will be seen in particular in FIG. 4, the seating pads 2011 and 2012 are situated at the level of the curved portion of the lateral wall 202, while the third seating pad 2013 is situated at the level of the portion of the wall 201 which is adjacent to the base 21 of the reflector. The angular positions of these pads with respect to the centre of the lamp hole 204 are chosen according to the type of lamp to be used, so as to correspond with the reference bosses or the like formed on the base collar of the lamp.

In the base region of the lateral wall 202, a recess 2021 is formed. The recess 2021 receives, as can be seen in particular in FIG. 3, a fastening lug 151 of an occulter or mask 15 which is arranged to be placed in front of the lamp 10 so as to prevent light from being emitted directly. The fastening lug 151 is secured by means of a screw or dowel 16, engaged in a hole 2027 formed in the base of the recess 2021 during moulding. A locating projection 2022 is formed in the edge of the lamp hole 204 for orientation of the lamp 10 in the lamp hole, so that it occupies the correct angular position about its axis. The configuration shown here is suitable for a lamp of the H7 type.

Figure 5:
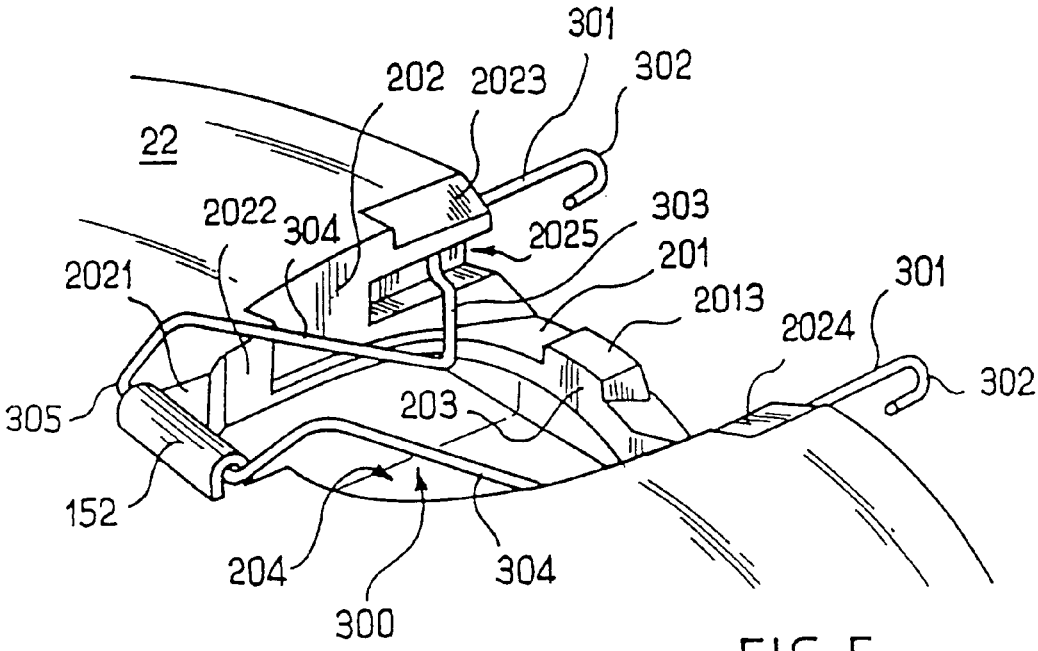
FIG. 5 is a perspective view of the lamp mount, with a retaining clip.

As will be observed in particular in FIGS. 2, 3 and 5, the fastening lug 151 of the mask has at its outer end a portion 152 which is bent back at 180° so as to form, jointly with the outer face of the reflector portion 22, a retaining element for a hairpin-type locking clip 300 for locking the lamp in position.

The locking clip 300 is made in the conventional way by bending of spring steel wire. It has two branches extending from the two ends of an attachment section 305 which is mounted within the portion 152. Each of these two branches of the clip has a maneuvering and locking section 301 which is essentially straight and which terminates at the free end of the branch concerned, in a terminal section 302 bent back through 180°. Between the maneuvering and locking section 301 and an attachment section 305, there is provided, in each branch, an engagement section which consists of two subsections 303 and 304, together defining a V, the apex of which is arranged to come into engagement against the outside of the base 13 that here constitutes the mounting means of the lamp, 10 thus locking the latter in position.

In the free end regions of the lateral wall 202, adjacent to the base portion 21 of the reflector, two notches 2025 are formed respectively integrally by moulding (see FIG. 5). The maneuvering and locking sections 301 of the branches of a hairpin-type locking clip 300 are arranged to engage in these notches 2025 by elastic expansion, so as to give the locking effect. Chamfers 2023 and 2024, constituting ramps, are formed close to these locking notches 2025, on the edge which separates the lateral wall 202 from the further portion 22, so as to facilitate engagement of the maneuvering and locking sections 301 during the locking operation.

Unlocking of the clip hairpin type locking 300 is effected simply by squeezing the two ends 3 of its two branches manually together so as to release the maneuvering and locking sections 301 from their respective notches 2025.

In this way, without any additional component, a lamp mount is obtained directly by means of arrangements which are formed integrally by moulding during manufacture of the reflector, and therefore in a simple and inexpensive way, such that the lamp mount ensures fully satisfactory positioning and retention of the lamp, and this despite the rake angles necessary on stripping from the mould.

Reference is now made to FIGS. 6 to 8, showing another embodiment of the invention which enables positioning of the lamp 10 transversely to its axis to be carried out with greater precision. In this version, the fastening lug 151 of the mask 15 is further provided, by contrast with the first embodiment just described, with an elastic tongue 153 which is formed by stamping out and permanent deformation. As can be seen in FIGS. 7 and 8, this elastic tongue 53 can be stamped out from a zone adjacent to a hole 154 through which the fastening screw or dowel 16 passes, so as to form a slot which defines a keyhole shape with the hole 154 between the latter and the mask 15 in the longitudinal direction of the fastening lug 151.

The elastic tongue 153 is deformed inwardly in such a way as to bear elastically against the edge of the base 13 of the lamp 10 at this point. At the same time, the hole lamp 204 for the lamp 10 is so configured, in its region diametrically opposed to the fastening lug 151 of the mask 15, that it has two V-shaped radial engagement faces 2075 and 2016 respectively, which are defined by base the wall 201 surrounding the lamp hole 204. Accordingly, the elastic tongue 153, by biasing the base 13 towards these engagement faces (as indicated by the arrow F in FIG. 8), provides a reference point for the position of the base 13 of the lamp 10 in the direction transverse to the axis of the lamp 10. In this case it is then sufficient, in order to ensure positioning of the lamp 10 with the required precision, to determine, particularly during design of the mould for the reflector, the position of these surfaces with respect to the base surface of the reflector.

Figure 9:
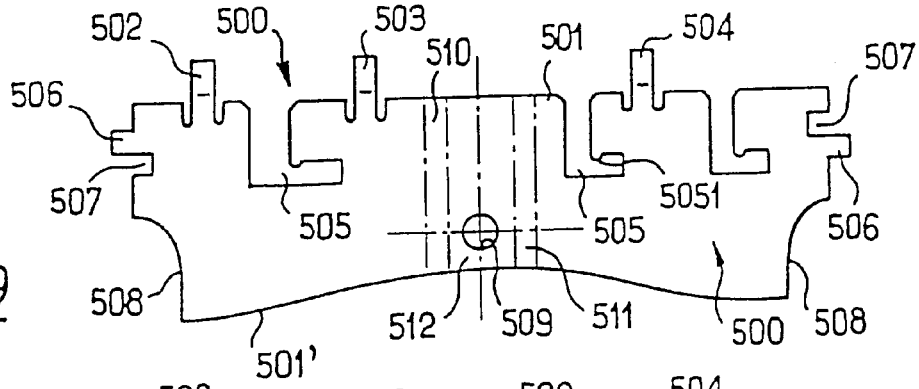
FIG. 9 is a developed plan view of a metal mounting member which is used in a lamp mount in a further embodiment of the invention.
Figure 10:
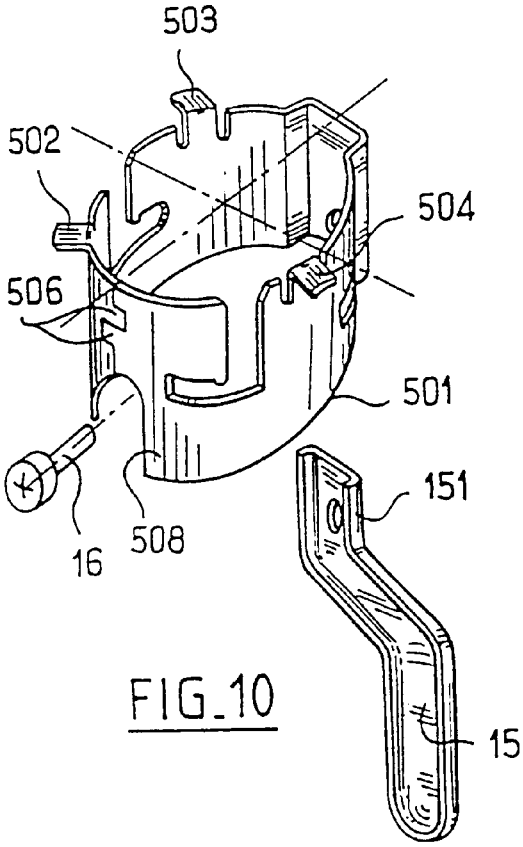
FIG. 10 is a perspective view of the member shown in FIG. 9, once it has been shaped.

Reference is now made to FIGS. 9 and 10, which show a further embodiment of the invention. In this version, fastening of the lamp 10 is no longer obtained by means of a locking clip of the hairpin type, but instead by means of a bayonet fitting. More precisely, the region of the reflector 20 which is adapted for mounting of the lamp 10 is similar to that described with reference to the foregoing Figures of the drawings, to the extent that the hole lamp 204 for the lamp 10 is bounded by the base wall 201 which constitutes an entirely smooth and flat shoulder inclined by the rake angle (which is typically 7°) necessary for stripping of the reflector from its mould. The wall base 201 thus, in this example, may not have the seating pads which are present in the versions already described above.

In this case, the lamp mount comprises a generally cylindrical metal element, which is shown in FIGS. 9 and 10, and which is indicated generally by the reference numeral 500. In FIG. 9, the cylinder is shown in developed, or flat, form. The cylindrical element 500 has a straight upper edge 501 and a lower edge 501' of sinuous form which is adapted so that, after the metal element 500 has been formed into its cylinder by bending along a circular generatrix, it forms a continuous circle in a plane which is inclined at 7° with respect to the plane that contains the circle formed at the same time by the upper edge 501.

The metal element 500, or mounting member, also includes three engagement lugs 502, 503 and 504 which are arranged to be bent back outwardly at 90° in such a way as to form three seating pads for the lamp, together with three generally L-shaped notches 505 and projections 505, which are typical of a bayonet fitting.

In addition, the forming of the metal element 500 to form the cylindrical mounting member also involves bending through about 90° on lines which separate a zone 512 and two edge zones 510 and 511, in such a way as to form, within the completed component, an outwardly projecting portion which is arranged to be closely lodged within a recess of the type typified by the reinforcing element 2021 described above. The purpose of this is to ensure that the metal element 500 will be correctly indexed to its proper angular position as it is mounted on the reflector.

It will be understood that, the lower edge 501' of the metal element 500, once the latter has been formed into its cylindrical shape, comes into engagement against the base wall 201, orientated in accordance with the rake angle, then the upper edge 501 of the element defines a circle which extends in a plane at right angles to the axis of the metal element 500, which is itself at right angles to the optical axis of the reflector. By engaging on the three seating pads formed by engagement lugs 502, 503 and 504 disposed in the same plane, the lamp 10 will then adopt the correct orientation in the reflector.

It will be noted here that the forming of the metal element 500 into its cylindrical form is effected by rolling the flat metallic leaf shown in FIG. 9, and putting the free ends of this leaf into conformity at their junction is ensured in this example by fingers 506 and notches 507 which are in mutual engagement. It will be observed finally that a hole 509 is arranged for the fastening screw or dowel 16 to pass through it, to be engaged in a hole such as the hole 2027 described for an earlier embodiment herein. It will also be noticed that there is a larger hole 508, diametrically opposite the hole 509, to enable a screwdriver for the screw 16 to be inserted.

It will also be noted that the opening left by the edge zones 510, 511 and the zone 512 of the metal element 500 may be used for the purpose of receiving the fastening lug 151 for fastening the mask 15, as is shown in FIG. 10.

Figure 11:
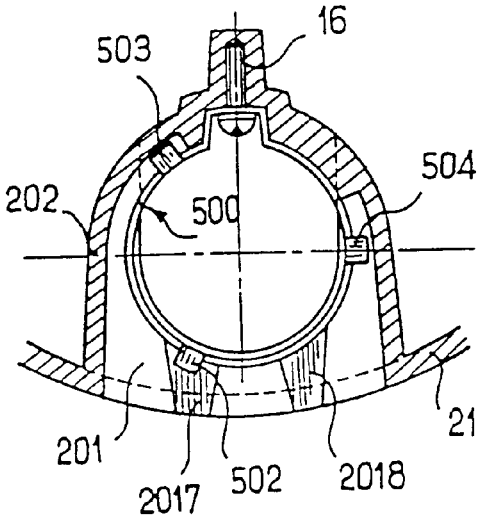
FIG. 11 is a plan view along the mounting axis of the lamp, of the lamp mount in this further embodiment of the invention.

Reference is now made to FIG. 11 which shows a modification to the embodiment just described. In this modification, the lower circle of the metal element 500, that is to say the one which is defined by its lower edge 501', may meet, not the inclined flat base wall 201 in accordance with the rake angle, but, instead, a certain number of pads, including in particular two pads 2017 and 2018. These pads may, as for the pads 2011, 2012, 2013 in the first embodiment described above, lie in a plane parallel to the optical axis of the reflector, in which case the metal element 500 is modified so as to adopt the form of a cylinder of any height whatever.

Any other arrangement of such pads is naturally possible, in which case the form of the lower edge 501' of the metal element 500 is suitably adapted from case to case.

Figure 12:
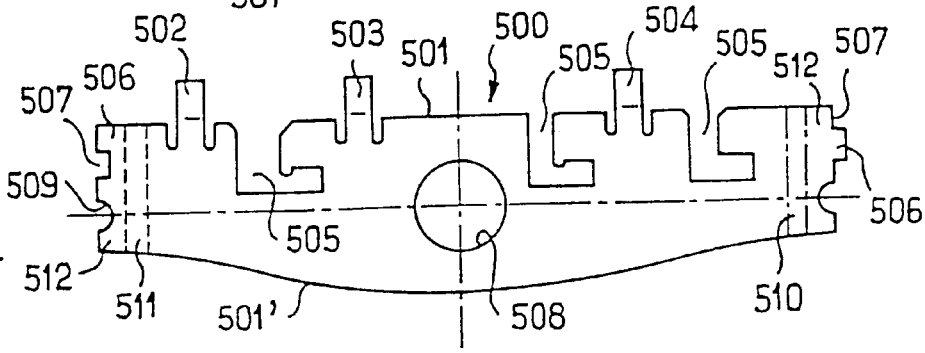
FIG. 12 is a developed plan view of a metal component in a further modified version.

Reference is now made to FIG. 12, which shows a further modified version of the metal element 500. This latter here has the same arrangements as those in FIG. 9, designated by the same reference numerals, but the two ends of the element, when formed into a cylinder, are joined together not at the level of the hole 508 for accommodating the screwdriving tool, but at the level of the zone 512. In this case, the screw 16 performs the further useful function of assisting retention of the metal element 500 in the state in which it is closed on itself.

The present invention is of course in no way limited to the embodiments described and shown herein, but the person skilled in this technical field will be able to apply any variant or modification to it in conformity with the spirit of the invention.

What is claimed is:

1. A motor vehicle headlight including a lamp defining a lamp axis, a reflector defining an optical axis of the reflector, and means carried by the reflector for mounting the lamp in the reflector with the said lamp axis at right angles to the said optical axis, the lamp having mounting means for engagement in a plane at right angles to the lamp axis, the reflector being of plastics material injection moulded in a mould and stripped from the said mould in a direction corresponding to that of the said optical axis, the reflector comprising a base portion and at least one further portion adjacent to the said base portion, wherein the said further portion includes a lamp hole formed directly therein and a reflector wall surrounding the lamp hole and having an external surface, the said external surface defining a rake angle with respect to the said direction corresponding to the optical axis, and wherein the headlight further includes, between the said surface and the said mounting means of the lamp, adapter means defining seating surfaces in a plane parallel to the said optical axis, for engagement of the said mounting means of the lamp on said seating surfaces.

2. A headlight according to claim 1, wherein the said adapter means comprise a generally cylindrical adapter member surrounding the lamp hole and having a first edge in engagement against the said outer surface and a second edge opposed to the said first edge, the said second edge defining seating surfaces for engagement by the said mounting means of the lamp.

3. A headlight according to claim 2, wherein the said adapter member defines circles in planes inclined with respect to each other by an angle equal to the said rake angle, the said first and second edges of the adapter member being essentially defined by the said circles.

4. A headlight according to claim 2, wherein the said external surface includes integral pads projecting therefrom, the said first edge of the adapter member bearing on the said pads.

5. A headlight according to claim 2, wherein the said adapter member further has notches for bayonet mounting of the lamp.

6. A headlight according to claim 2, wherein the adapter member has lugs lying in a plane at right angles to the axis of the said member and constituting the said seating surfaces defined by the second edge of the adapter member.

7. A headlight according to claim 2, wherein the adapter member is formed by rolling a thin piece of sheet metal.

8. A headlight according to claim 1, wherein the said adapter means comprise a plurality of pads projecting from the said external surface and formed integrally with the reflector by moulding.

9. A headlight according to claim 8, further including a retaining member carried by the reflector and engaging the lamp for retention of the lamp in the reflector by pressure of the mounting means of the lamp on the said pads.

10. A headlight according to claim 9, wherein the said further reflector portion includes a reinforcement, the said lamp hole and surface surrounding the lamp hole being formed in the reinforcement, the reflector having a generally U-shaped wall defining the said reinforcement, and the headlight further including a mask for masking the lamp, said mask having a fastening lug, the said generally U-shaped reflector wall including at least one reinforcement for receiving the said lug, wherein the said retaining member comprises a hairpin-typespring clip articulated on the said fastening lug of the mask.

11. A headlight according to claim 1, wherein the said further reflector portion includes a reinforcement, the said lamp hole and surface surrounding the lamp hole being formed in the reinforcement.

12. A headlight according to claim 2, wherein the reflector has a generally U-shaped wall defining the said reinforcement.

13. A headlight according to claim 12, wherein the said generally U-shaped wall has at least one locating means for determining the angular position of the lamp.

14. A headlight according to claim 12, further including a mask for masking the lamp, said mask having a fastening lug, the said generally U-shaped reflector wall including at least one reinforcement for receiving the said lug.

15. A headlight according to claim 14, wherein the said fastening lug includes a portion defining an elastic tongue for biasing the lamp whereby to locate the lamp in a direction transverse to the said lamp axis.

* * * * *

UNITED STATES PATENT AND TRADEMARK OFFICE

CERTIFICATE OF CORRECTION

PATENT NO. : 6,250,790 B1
DATED : June 26, 2001
INVENTOR(S) : Maurice Montet

It is certified that error appears in the above-identified patent and that said Letters Patent is hereby corrected as shown below:

Column 8,
Line 22, “hairpin-typespring” should read -- hairpin-type spring --.
Line 28, “claim 2” should read -- claim 11 --.

Signed and Sealed this

Eighteenth Day of June, 2002

*Attest:*

*Attesting Officer*

JAMES E. ROGAN
*Director of the United States Patent and Trademark Office*